US008899241B2

(12) United States Patent
Vandromme

(10) Patent No.: US 8,899,241 B2
(45) Date of Patent: Dec. 2, 2014

(54) INSTRUMENT FOR APPLYING A PRODUCT TO SUPERFICIAL EPIDERMAL DERIVATIVES AND ITS METHOD OF MANUFACTURE

(75) Inventor: Michel Maurice Camille Vandromme, Le Plessis Brion (FR)

(73) Assignee: Yves Saint Laurent Parfums, Neuilly sur Seine (FR)

( * ) Notice: Subject to any disclaimer, the term of this patent is extended or adjusted under 35 U.S.C. 154(b) by 792 days.

(21) Appl. No.: 12/298,790

(22) PCT Filed: Apr. 27, 2007

(86) PCT No.: PCT/FR2007/000721

§ 371 (c)(1),
(2), (4) Date: Feb. 27, 2009

(87) PCT Pub. No.: WO2007/125207

PCT Pub. Date: Nov. 8, 2007

(65) Prior Publication Data

US 2009/0194128 A1 Aug. 6, 2009

(30) Foreign Application Priority Data

Apr. 28, 2006 (FR) ..... 06 03868

(51) Int. Cl.

| | |
|---|---|
| ***A45D 40/26*** | (2006.01) |
| ***A46B 9/02*** | (2006.01) |
| ***A46B 3/18*** | (2006.01) |

(52) U.S. Cl.

CPC . *A46B 3/18* (2013.01); *A46B 9/021* (2013.01); *A46B 2200/1053* (2013.01); *A45D 40/265* (2013.01)

USPC ..... 132/218; 15/187; 15/206; 300/21

(58) Field of Classification Search

USPC ..... 132/218, 317, 320; 15/187, 188, 206; 300/21

See application file for complete search history.

(56) References Cited

U.S. PATENT DOCUMENTS

| | | | | |
|---|---|---|---|---|
| 1,333,663 | A * | 3/1920 | Kirby | 15/206 |
| 4,422,986 | A | 12/1983 | Cole | |
| 5,722,436 | A * | 3/1998 | Vandromme et al. | 132/218 |
| 6,260,558 | B1 * | 7/2001 | Neuner | 132/218 |

FOREIGN PATENT DOCUMENTS

| | | |
|---|---|---|
| EP | 0410821 A1 | 1/1991 |
| WO | 0207559 A2 | 1/2002 |

OTHER PUBLICATIONS

Search Report for International Patent Application No. PCT/FR2007/000721; Nov. 30, 2007.

* cited by examiner

*Primary Examiner* — Rachel Steitz

(74) *Attorney, Agent, or Firm* — Jason A. Bernstein; Barnes & Thornburg LLP

(57) ABSTRACT

An instrument (1) for applying a product to superficial epidermal derivatives comprising an elongated core (4) and at least one nucleus (5) supporting an applicator (6) of the product. The core (4), which is twisted, passes through the nucleus (5), and the core (4) and nucleus (5) are connected to prevent the nucleus (5) from pivoting freely on the core (4).

22 Claims, 2 Drawing Sheets

INSTRUMENT FOR APPLYING A PRODUCT TO SUPERFICIAL EPIDERMAL DERIVATIVES AND ITS METHOD OF MANUFACTURE

PRIORITY CLAIM

This patent application is a U.S. National Phase of International Patent Application No. PCT/FR2007/000721, filed Apr. 27, 2007, which claims priority to French Patent Application No. 0603868, filed Apr. 28, 2006, the disclosures of which are incorporated herein by reference in their entirety.

FIELD

The present disclosure relates to devices for applying products, particularly cosmetic products, to an area of the human body preferably containing epidermal derivatives, and, in particular, filiform and keratinized epidermal derivatives, such as eyelashes.

The present disclosure relates more particularly to an instrument for applying a product to epidermal derivatives comprising, on the one hand, an elongated core and, on the other, at least one nucleus supporting a means of application of the product, the core passing through the nucleus, and the core and the nucleus being connected to basically prevent the nucleus from pivoting freely on the core.

The present disclosure also relates to a method of manufacturing an instrument for applying a product to epidermal derivatives.

In its preferential application, the instrument according to the present disclosure constitutes a mascara applicator for eyelashes designed to pick up a quantity of mascara in a container and transport this quantity to the eyelashes to deposit the mascara on the eyelashes.

BACKGROUND

Mascara applicators in the form of brushes are already known. Such brushes typically comprise a gripping component, which may serve as a stopper for a container containing the mascara to be applied, together with a stem extending from the gripping component between a proximal end and a distal end.

A multitude of bristles extend radially from the stem, at its distal end, thus forming an application head.

These prior art brushes are designed to be used as follows.

The user dips the brush in a container containing mascara which has the effect of coating the bristles and the stem with mascara. The user then performs an eyelash brushing action using the brush which has the effect of transferring the mascara from the brush towards and onto the eyelashes, combing the eyelashes in the process.

We are familiar, in particular, with mascara brushes of which the application head is formed by a straight shaft positioned at the distal end of the stem, in line with the stem, and on which identical disks containing a central hole are threaded one behind the other. Each disk has teeth extending radially in a ring, the teeth forming the bristles of the brush, that is to say the brush's means of application.

To prevent the rotation of the disks on the shaft, the central hole in each disk, in which the shaft is inserted, presents a non-circular section, the sections of the hole in each disk, on the one hand, and of the shaft, on the other hand, are matched to prevent the free rotation of the disks on the shaft.

Such a construction of the application head lends itself well to automated manufacturing enabling production of original and cheap brushes given that this construction is based on a very simple mechanical assembly (by threading) of disks which are all identical and a shaft.

Such a brush construction is not without drawbacks, however.

In particular, because the disks are all identical to each other (for economic reasons, in particular) and the disks cannot pivot on the shaft, their teeth are consequently all aligned along the shaft and form straight rows extending parallel to the shaft.

Now it may be worthwhile, notably from the point of view of the cosmetic result, to obtain an "expansion" of the teeth forming the bristles, that is to say a distribution of the bristles along the shaft which, without necessarily being disordered or random, prevents the forming of areas without bristles along the whole length of the shaft, like the areas separating each longitudinal row of teeth of the prior art brushes.

SUMMARY

The present disclosure describes several exemplary embodiments of the present invention.

One aspect of the present disclosure provides an instrument for applying a product to epidermal derivatives, the instrument comprising a) an elongated core having at least a portion of which is twisted; and b) at least one nucleus supporting an applicator of the product; wherein the core passes through the nucleus, and wherein the core and the nucleus are connected to prevent the nucleus from pivoting freely on the core.

Another aspect of the present disclosure provides a method of manufacturing an instrument for applying a product to epidermal derivatives, the method comprising a) providing an elongated core; b) providing at least one nucleus supporting an applicator of the product; and c) assembling the core and at least one nucleus such that the core passes through the nucleus, wherein the core and the nucleus are connected to prevent the nucleus from pivoting freely on the core, and wherein the core is twisted.

The features of the present disclosure remedy the various drawbacks listed above and provide an instrument for applying a product to epidermal derivatives which is of particularly simple and economical construction while at the same time allowing improved expansion of its means of application.

Another feature of the present disclosure provides an instrument for applying a product to epidermal derivatives which is particularly easy to manufacture.

Another feature of the present disclosure provides an instrument for applying a product to epidermal derivatives of which the construction is based on mechanical principles which are particularly simple and easy to implement.

Another feature of the present disclosure provides a particularly cheap instrument for applying a product to epidermal derivatives.

Another feature of the present disclosure provides an instrument for applying a product to epidermal derivatives enabling an expansive but regular and controlled distribution of the means of application.

Another feature of the present disclosure provides a method of manufacturing an instrument for applying a product to epidermal derivatives which is particularly simple and cheap to implement while at the same time enabling the production of an instrument of which the means of application presents an optimized expansion.

Another feature of the present disclosure provides a method of manufacturing an instrument for applying a product to epidermal derivatives of which the steps lend themselves particularly well to automation.

Another feature of the present disclosure provides a method of manufacturing an instrument for applying a product to epidermal derivatives of which the implementation is particularly quick, inexpensive and easy to industrialize.

BRIEF DESCRIPTION OF THE DRAWINGS

Various aspects of the present disclosure are described hereinbelow with reference to the accompanying figures.

Other advantages and features of the invention will appear in greater detail on reading the description hereinbelow with the help of the drawings which are supplied purely for explanation and are not limiting.

DETAILED DESCRIPTION

Figure 1:
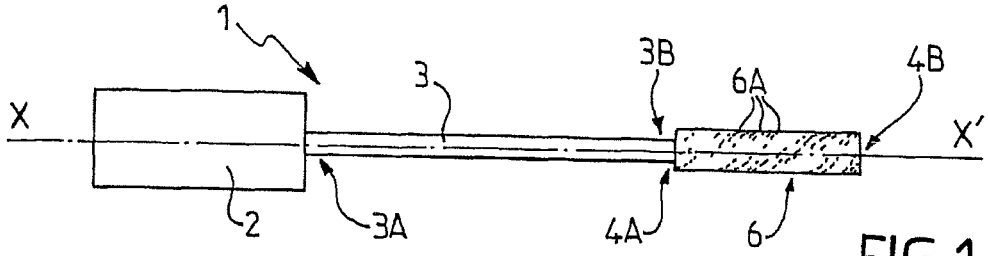
FIG. 1 is a general side view of an instrument according to one exemplary embodiment of the present disclosure designed for applying mascara on eyelashes.

The present disclosure relates to an instrument 1 for applying a product, preferably liquid, semi-liquid (for example, pasty) or powdery, to epidermal derivatives and, in particular, to fibrous keratinic epidermal derivatives such as bodily hairs (for example, eyelashes, eyebrows, beard and moustache) or hair on the head.

Advantageously, the product to be applied is a cosmetic product, with the result that the instrument 1 constitutes, in this case, a cosmetic instrument.

Preferentially, the product to be applied is mascara for eyelashes. The instrument 1 then constituting a mascara applicator for eyelashes.

For reasons of simplicity of description, the text hereinbelow refers, as an example, exclusively to such a mascara applicator. The present disclosure is not, however, limited to applying a product necessarily of a cosmetic nature nor to applying a product necessarily of the same consistency as mascara. The instrument 1 may be used to apply any product, whatever its consistency. The product may, for example, be very fluid or, on the contrary, be very viscous and/or pasty, or the product may take the form of a powder.

In a manner known per se, the instrument 1 comprises a gripping component 2 designed to be gripped and manipulated manually by a user, for example, between two or three fingers. The instrument 1 is, therefore, typically of a portable nature and is intended for manual use. Preferentially, the gripping component 2 may also be shaped to serve as a stopper for a container (not shown) containing a stock of product to be applied, which is preferably mascara for eyelashes. Such an arrangement is standard and will not, therefore, be described in detail below.

Preferably, the instrument 1 comprises a stem 3 extending roughly in a straight line in an axial direction X-X' from the gripping component 2 between a proximal end 3A and a distal end 3B.

In accordance with the present disclosure, the instrument 1 comprises a core 4. The core 4 is preferably positioned towards the distal end 3B of the stem 3, and even more preferentially, as illustrated in the figures, extends roughly in a straight line from the distal end 3B, in line with the stem 3, along the axis X-X' between a first end 4A connected to the distal end 3B and a second free end 4B.

In the examples illustrated in the figures, the core 4 is distinct from the stem 3 and is attached to it, for example, by crimping. It is, however, quite feasible for the core 4 to be directly formed by the stem 3 itself. It also feasible for the instrument 1 not to include the stem 3, the core 4 being directly connected to the gripping component 2. It is also possible for the core 4, and more particularly its first end 4A, to be shaped to directly constitute the gripping component 2 by itself without departing from the scope of the present disclosure.

It is also feasible for the core 4 not to extend strictly in a straight line, as illustrated in the figures, but alternatively to present a slightly curved shape (not shown) instead, for example, corresponding to the average profile of implantation of the eyelashes. In this case, the axial direction X-X' is obviously not defined by a straight line but by a curved line which follows the axis of extension of the core 4.

In accordance with the exemplary embodiment illustrated in the figures, the core 4 presents a slender, elongated shape. In other words, the core 4 presents a long, thin, filiform shape. The core 4 can thus be described as slender, that is to say the core 4 extends mainly in a single direction in space, in this instance, the axial direction X-X'. In this sense, the core 4 is mainly one-dimensional.

In accordance with the present disclosure, the instrument 1 also comprises at least one nucleus 5 supporting a means of application 6 (also referred to as an applicator) of the product to be applied on epidermal derivatives. The nucleus 5 thus forms a support for the means of application 6, this means of application is mounted on the nucleus 5. Preferably, as illustrated, in particular, in FIGS. 2, 4 and 7, the means of application 6 is one with the nucleus 5, that is to say the means of application 6 forms with this nucleus a single one-piece part. Naturally, the means of application 6 may be distinct and independent from the nucleus 5 and be attached on the nucleus 5 by any appropriate means, for example, by gluing, flocking, heat-sealing, crimping or mechanical assembly.

In the exemplary embodiments of production illustrated in the figures, which will be described in greater detail hereinbelow, the instrument 1 preferably comprises a plurality of distinct nuclei 5 (see FIG. 2, in particular) each supporting a corresponding means of application.

It is, however, quite feasible for the instrument 1 to comprise only one nucleus 5 supporting a single unitary means of application 6, without departing from the scope of the present disclosure.

The means of application 6 supported by the nucleus 5 is designed to collect a product (for example, mascara) and apply it to epidermal derivatives (for example, eyelashes). The means of application 6 is, therefore, preferentially specifically designed to pick up the product to be applied, for example, by being immersed in a reserve of this product, and to retain and contain this quantity of product picked up until its release on the epidermal derivatives, performed preferably by placing in contact and rubbing the means of application 6 with and against the epidermal derivatives.

In the exemplary embodiments illustrated in the figures in which the instrument 1 constitutes a mascara applicator for eyelashes, the means of application 6 also allows, simultaneously with the coating of the eyelashes with mascara, the performing of an eyelash combing and separating function. For this purpose, the means of application 6 preferentially comprises protuberances 6A protruding from the nucleus 5, preferably radially with respect to the axis X-X'. In other words, the means of application 6 juts out with respect to the nucleus 5 and advantageously forms a multitude of protuberances from the nucleus 5. In the exemplary embodiment illustrated in the figures, the protuberances 6A thus form combing teeth, that is to say brush bristles which enable the eyelashes to be coated with mascara while at the same time the eyelashes are combed.

Figure 3:
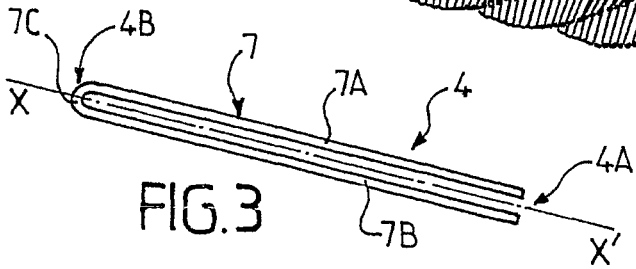
FIG. 3 is a schematic perspective view of the core of the instrument shown in FIGS. 1 and 2 before the core is twisted.
Figure 7:
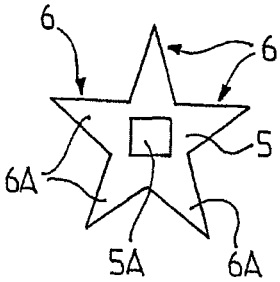
FIG. 7 is a front view of a second exemplary embodiment of a nucleus supporting a means of application and used in the construction of the instrument equipped with the core shown in FIG. 6.
Figure 8:
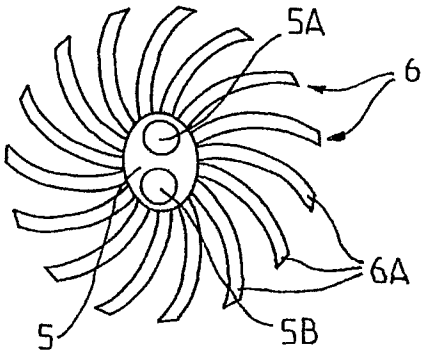
FIG. 8 is a front view of a third exemplary embodiment of a nucleus supporting a means of application.

Preferentially, as illustrated in FIGS. 3, 7 and 8, the nucleus 5 and the means of application 6 which the nucleus supports are both formed by a single roughly star-shaped part, the central core of the star being formed by the nucleus 5 while the points of the star are formed respectively by the radial protuberances 6A of the means of application 6 which extend radially and centrifugally with respect to the axis X-X' from the nucleus 5.

Naturally, the present disclosure is not limited to a particular structure of the means of application, this structure being essentially dictated by the consistency of the product to be applied, the nature of the receiving support (for example, eyelashes or fingernails), and the required cosmetic effect.

In accordance with the present disclosure, the core 4 passes through the nucleus 5, that is to say the core 4 passes through each nucleus 5 if the instrument 1 comprises a plurality of nuclei, as illustrated in the figures.

The core 4 and the nucleus 5 are also connected to prevent the nucleus 5 from pivoting freely on the core 4, In other words, the core 4 and the nucleus 5 are mechanically connected to basically prevent the nucleus 5 from pivoting freely on the core 4, that is to say the mechanical connection between the nucleus 5 and the core 4 is such that any relative rotation of the nucleus 5 around the core is basically prohibited.

Thus the core 4 passes through the nucleus 5 in such a way that the interface between the core 4 and the nucleus 5 prevents the nucleus 5 from rotating freely on the elongated core 4 and reciprocally prevents the elongated core 4 from rotating freely within the nucleus 5.

Naturally, this function of blocking the rotation of the nucleus 5 with respect to the core 4 can be performed in many ways, the present disclosure not being limited to any one of these ways, in particular. Thus, in the exemplary embodiment illustrated in FIGS. 1-5, each nucleus 5 has at least two distinct holes 5A, 5B through its whole thickness while the core 4 comprises at least two branches attached to each other and designed to be inserted in the holes 5A, 5B, respectively. Such a technical measure thus enables anchoring of the nucleus 5 on the core 4 at two distinct points, which de facto prohibits the free rotation of the nucleus 5 on the core 4, regardless of the shape of the holes 5A, 5B and of the corresponding branches of the core 4.

Figure 6:
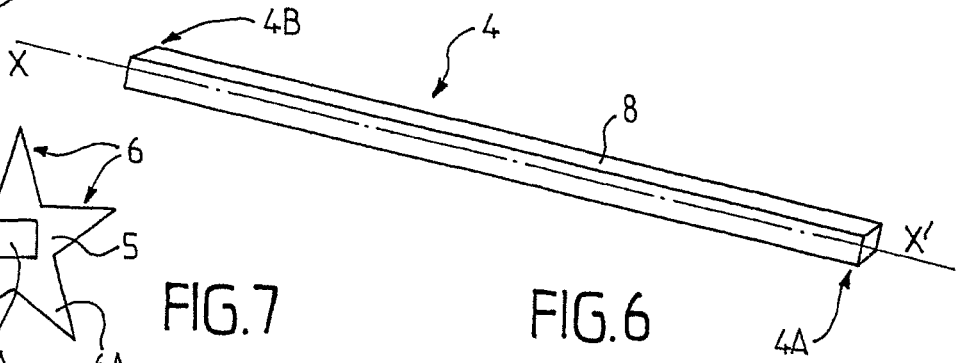
FIG. 6 is a perspective view of a second exemplary embodiment of the core of an instrument before it is twisted according to the present disclosure.

Alternatively, as illustrated in FIGS. 6 and 7, it is also feasible to provide each nucleus 5 with a single through hole 5A presenting a non-circular shape, such as a faceted shape, the hole cooperating with a one-piece core 4 of which the cross section is of a shape matching that of the hole 5A. For example, according to the exemplary embodiment illustrated in FIGS. 6 and 7, the single hole 5A presents a square section just like the core 4 with the result that once the core 4 is inserted in the hole 5A, the core 4 cannot rotate freely inside it.

In accordance with an important feature of the present disclosure, the core 4 is twisted, that is to say the core 4 is bent helically in a spiral along its axis of extension X-X'. The twisted nature of the core 4 can naturally be obtained in various ways.

For example, in the exemplary embodiments illustrated in the figures, the core 4 is initially untwisted, straight and rectilinear, as illustrated in FIGS. 3 and 6. This untwisted core 4, which can be described as the primary core, is subjected to twisting, carried out, for example, by applying to one of its parts a movement of rotation around the axis X-X' (for example, in the clockwise direction) while the other parts remain fixed or are subjected to a movement in the opposite direction (for example counterclockwise). This torsional force is applied to impart a plastic deformation to the core 4 with the result that the core adopts its twisted shape in a stable and permanent manner.

Alternatively, it is feasible to obtain the twisted core 4 directly without any twisting step, for example, by molding in a mold presenting a twisted shape.

Owing to the connection between the core 4 and the nucleus 5 which prevents the nucleus 5 from pivoting freely on the core 4 and vice versa, the angular position of the nucleus 5 and the means of application 6 the nucleus 5 supports is conditioned, along the axis X-X', by the helical, twisted profile of the core 4. This leads, as will be explained in greater detail hereinbelow, to an expansion of the means of application 6, that is to say an angular offset, along the core 4 and the axis X-X' of the components (in this instance, the protuberances 6A) forming the means of application 6. In other words, it leads to a relative angular offset of at least two nuclei supporting the means of application 6 (in this instance, the protuberances 6A), and preferentially of all the nuclei, along the core 4 and the axis X-X'. The means of application 6 thus preferentially presents a helical profile.

The three exemplary embodiments of the present disclosure illustrated in FIGS. 1-5, 6 and 7, and 8-10, respectively, will now be described in greater detail below.

In each of these three exemplary embodiments, the instrument 1 comprises a plurality of distinct nuclei 5 each supporting a corresponding means of application 6.

More precisely, the nuclei 5 are basically identical to each other. In the same way, the means of application 6 supported by the nuclei 5 are also identical to each other.

In each of these three exemplary embodiments, each nucleus 5 forms a one-piece part with the means of application 6 the nucleus 5 supports. More precisely, each nucleus 5 used in these three exemplary embodiments presents a plate shape, that is to say each of the nuclei 5 presents a very small thickness compared to its other dimensions, for example, a thickness between 0.05 and 1 mm, the thickness being preferentially approximately 0.2 mm.

In the exemplary embodiment illustrated in FIGS. 1-5, the nucleus 5 is roughly oval in shape and solid and has two identical holes 5A, 5B of circular section. Radial blades forming the protuberances 6A extend from the periphery of the nucleus, the radial blades presenting an elongated roughly rectangular shape and being distributed on the whole perimeter of the nucleus 5 in a regular angular distribution. These blades which form the protuberances 6A of the exemplary embodiment illustrated in FIGS. 1-5 extend in a straight line roughly radially with respect to the axis X-X', in the same plane of extension as the nucleus. This common plane of extension is roughly perpendicular to the axis X-X'.

In the exemplary embodiment illustrated in FIGS. 1-5, there are twelve radial blades forming the protuberances 6A, although the present disclosure is in no way limited to a particular number of protuberances 6A.

In the exemplary embodiment illustrated in FIGS. 6 and 7, the one-piece part forming both the nucleus 5 and the means of application 6 is shaped like a five-pointed star, each of the five points being roughly triangular. The nucleus 5, in this case, has a single hole 5A of square cross section.

Figure 9:
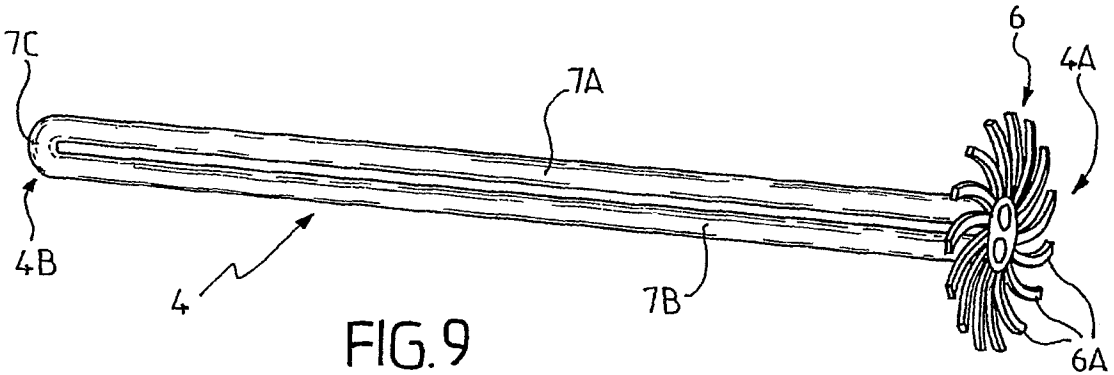
FIG. 9 is a perspective view of the cooperation of the nucleus supporting a means of application shown in FIG. 8 and the as yet untwisted core shown in FIG. 3.
Figure 10:
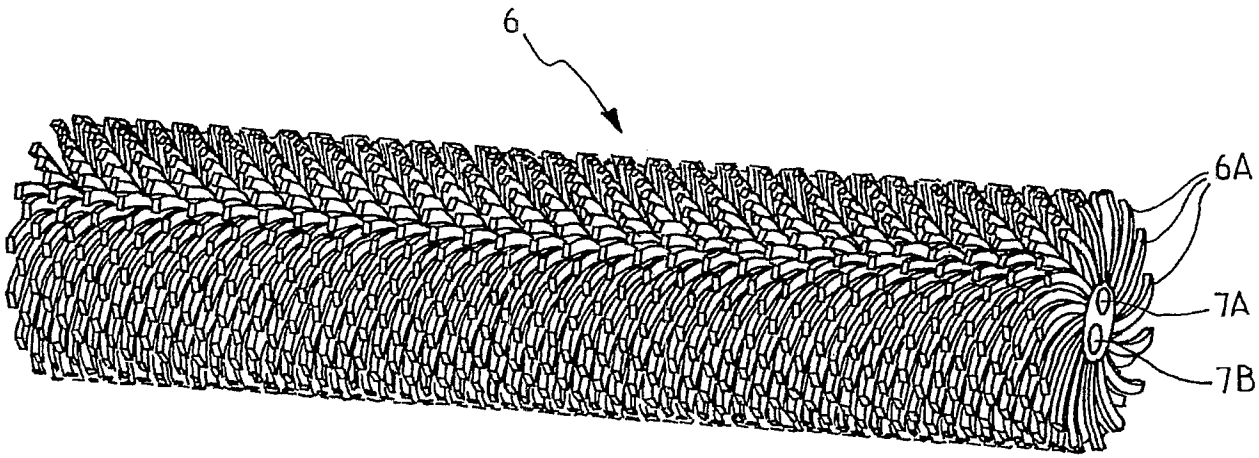
FIG. 10 is the perspective view shown in FIG. 9, wherein a plurality of nuclei complying with the third exemplary embodiment is inserted on the core and the core is twisted.

In the exemplary embodiment illustrated in FIGS. 8-10, the one-piece part forming both the nucleus 5 and the means of application 6 is roughly the same in shape as that illustrated in FIGS. 1-5 except that the radial blades forming the protuberances 6A are not straight but curved, that is to say curved in the plane of extension of the nucleus 5, and there are fifteen of the blades.

This curved shape of the blades improves eyelash/brush contact while applying make-up resulting, in particular, in a soft "feel".

Figure 4:
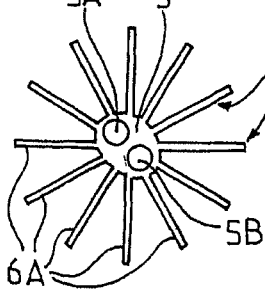
FIG. 4 is a front view of a nucleus supporting a means of application used in the construction of the instrument shown in FIGS. 1-3.
Figure 5:
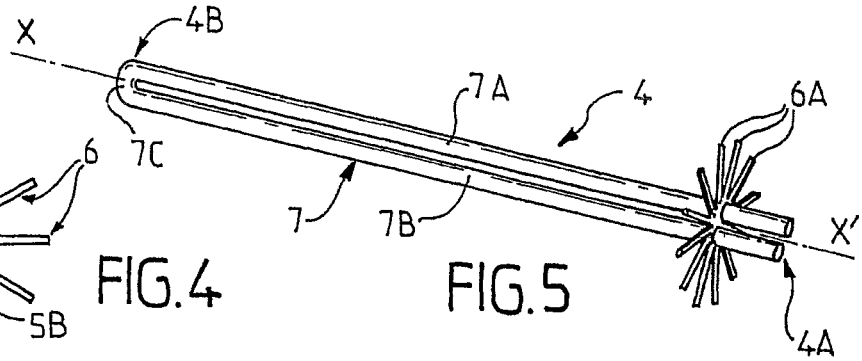
FIG. 5 is a perspective view of the cooperation of the nucleus supporting a means of application shown in FIG. 4 and the as yet untwisted core shown in FIG. 3.

In the exemplary embodiments illustrated in FIGS. 1-5 on the one hand, and FIGS. 8-10 on the other, the core 4 advantageously comprises, as illustrated, in particular, in FIGS. 3, 5 and 9, at least one U-shaped pin 7 with two longitudinal branches 7A, 7B extending in two roughly parallel directions of extension. The two longitudinal branches 7A, 7B are connected by a transverse arm 7C which advantageously presents a curved shape and extends in line with the branches 7A, 7B. Such a U-shaped pin is sometimes referred to as a "stirrup" in the technical field of the present disclosure.

The transverse branches 7A, 7B are inserted respectively in the two holes 5A, 5B passing through the whole thickness of the nucleus 5 illustrated in FIG. 4. In other words, in this exemplary embodiment, the nucleus 5 has two holes 5A, 5B into which the longitudinal branches 7A, 7B are inserted respectively. Preferably, the pin 7 is made of a plastically deformable material, for example, a metallic material such as steel. Preferably, the pin 7 is produced by simple bending of a straight, one-piece metal wire.

In the exemplary embodiments illustrated in FIGS. 1-5 on the one hand, and FIGS. 8-10 on the other, the instrument 1 comprises a plurality of distinct and independent nuclei 5 formed by parts which are all identical to each other, the nuclei 5 being stacked against each other as illustrated in FIG. 1. Each nucleus 5 is thus passed through by the core 4.

Advantageously, each nucleus 5 is threaded on the pin 7, that is to say on the branches 7A, 7B by means of its two holes 5A, 5B, while the core 4, that is to say the pin 7 in this instance, is not yet twisted (as illustrated in FIGS. 5 and 9). The parts forming the nucleus 5 and the means of application 6 are thus threaded one after the other on the pin 7 in such a way as to cover basically the whole length of the pin 7 with the exception of a marginal fraction, for example, near the first end 4A, designed to be attached to the stem 3. The plurality of nuclei 5 thus forms a stack along the axis X-X'.

A torsional force is then exerted along the axis X-X' on the pin 7 so as to deform the longitudinal branches 7A, 7B with the result that the longitudinal branches 7A, 7B each adopt a roughly helical profile around the axis X-X'. This torsional force may be localized on at least two nuclei or preferentially be exerted on all the nuclei stacked along the core 4.

Figure 2:
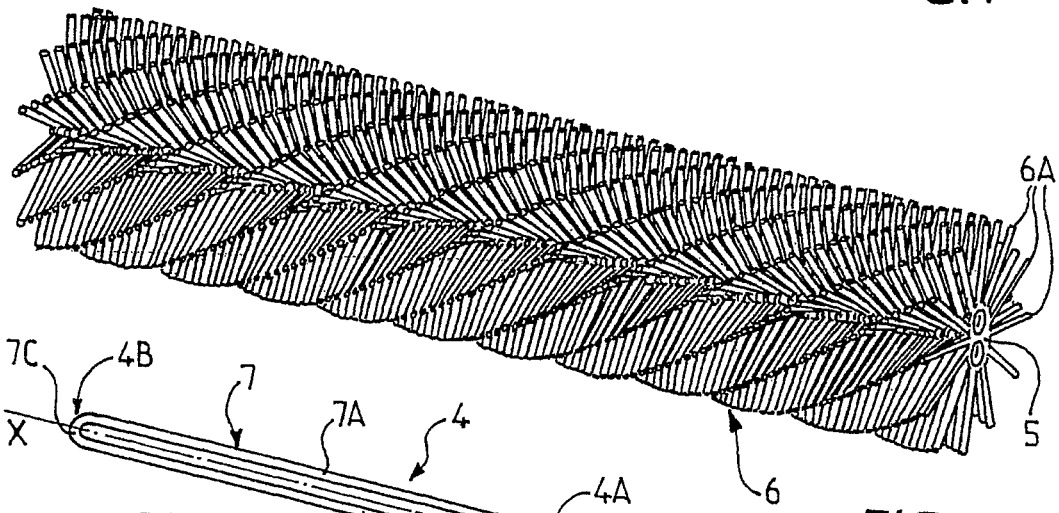
FIG. 2 is a perspective view of a detail of production of the instrument shown in FIG. 1, and more particularly a stack of nuclei supporting means of application, the core not being shown.

This simultaneously leads to the modification of the angular position of each nucleus 5 and, therefore, of the blades forming the protuberances 6A supported by the nuclei 5. More precisely, before the torsional force was applied on the pin 7, the blades forming the protuberances 6A were aligned in straight rows roughly parallel to the axis X-X' given that the one-piece parts forming the nucleus 5 and the means of application 6 are all identical. Following the application of the torsional force on the pin 7, the blades forming the protuberances 6A are all offset, preferably helically with respect to each other along the axis X-X', with the result that helical layers of blades now extend in place of the initial rows of blades, as illustrated in FIGS. 2 and 10.

The twisted nature of the core 4 thus enables an expansion of the blades supported by each nucleus 5, that is to say a better angular distribution of the blades preventing, in particular, the forming of longitudinal areas entirely without blades. This expansion, which leads advantageously to the forming of intertwined layers of protuberances 6A extending helically around the axis X-X, optimizes, in particular, the eyelash combing and curling effect and the cosmetic quality.

In the exemplary embodiment illustrated in FIGS. 6 and 7, the principle of construction and obtaining of the instrument 1 is similar to that used in the exemplary embodiments illustrated in FIGS. 1-5 and FIGS. 8-10 in that the core 4 is formed by a bar 8 with a square cross section corresponding to the section of the hole 5A, the nuclei 5 being inserted on the bar 8 by means of the single square hole 5A. The initially untwisted bar 8 is then subjected to a torsional force. In the same way that the two branches 7A, 7B control the angular position of each nucleus 5, the square section of the bar 8 enables control of the same nature and, therefore, an angular offset, along the axis X-X', of the protuberances 6A with the result that these protuberances form helical layers along the axis X-X'.

Hereinabove, exemplary embodiments have been described using a plurality of distinct nuclei; but, the present disclosure may also use a single flexible nucleus (not shown) initially supporting straight rows of protuberances forming the means of application, this single nucleus extending longitudinally over a length corresponding roughly to that of the core 4. In this case, the twisting of the core generates a twisting of the nucleus along the axis X-X' and, therefore, an expansion of the protuberances supported by this single nucleus.

It is also feasible for the core to be one with the nucleus. Given the embedding connection between the nucleus and the core, the twisting of the core leads to the twisting of the nucleus and, therefore, the expansion of the means of application the nucleus supports.

In another exemplary embodiment of the present disclosure, it is also conceivable for the twisting of the core to apply only to some of the nuclei stacked on the core, that is to say at least two nuclei. The twisting of the part of the core then leads to the twisting of the nuclei supported by the part of the core and, therefore, the expansion of the means of application the nuclei support.

The present disclosure also relates to a method of manufacturing an instrument 1 for applying a product to epidermal derivatives and, in particular, of an instrument 1 in accordance with that described hereinabove.

Preferably, the method according to the present disclosure constitutes a method for manufacturing a mascara applicator for eyelashes.

The method according to one exemplary embodiment of the present disclosure comprises a first supply step in the course of which either an elongated core 4 is manufactured or an already manufactured elongated core 4 is procured.

This method also comprises a second supply step in the course of which either at least one nucleus 5 supporting a means of application 6 of the product to be applied is manufactured or at least one already manufactured nucleus 5 (supporting a means of application of the product) is procured.

This method also comprises an assembly step in the course of which the core 4 and the nucleus 5 are assembled in such a manner that the core 4 passes through the nucleus 5. The core 4 and the nucleus 5 are connected to basically prevent the nucleus 5 from pivoting freely on the core 4.

In other words, the core 4 and the nucleus 5 are, in the course of the assembly step, mechanically connected to basically prevent the nucleus 5 from pivoting freely on the core 4.

Lastly, the method comprises a twisting step in the course of which the elongated core 4 is twisted.

As has been mentioned hereinabove, this twisting is advantageously performed after the assembly step. Thus, in the exemplary embodiments illustrated in the figures, the nuclei 5 are first inserted on the core 4 and then the core is twisted to generate an angular offset of the nuclei 5 with respect to each other. In other words, there is a relative angular offset of at least two nuclei 5 supporting the means of application 6, and preferentially of all the nuclei, along the core 4 and the axis X-X'.

In the course of the twisting step, the nuclei 5 remain advantageously roughly centered on the axis X-X' with the result that the general direction of extension of the instrument 1 remains unchanged between the assembly step and the twisting step.

Advantageously, in the course of the second supply step, a plurality of nuclei 5 each supporting a corresponding means of application 6 are manufactured. Preferably, in the course of this second supply step, a one-piece part forming both the nucleus 5 and the means of application 6 supported by the nucleus 5 are cut in a plate, preferably with a laser. For example, the one-piece parts in question are cut in a silicon or polytetrafluoroethylene (PTFE) plate using a laser cutting tool. This method enables a large number of one-piece parts similar to that illustrated in FIG. 4 and described hereinabove to be obtained very rapidly and industrially, at low cost and with good repeatability.

Advantageously, in the course of the assembly step, the nuclei 5 are stacked on each other, each nucleus 5 being passed through by the core 4 as already described hereinabove.

Advantageously, as already mentioned hereinabove, in the course of the first supply step, a U-shaped pin 7 with two longitudinal branches 7A, 7B connected by a transverse arm 7C is manufactured or procured.

Advantageously, in the course of the second supply step, at least one nucleus 5 supporting a means of application 6 of the product to be applied is manufactured or procured, the nucleus 5 having two holes 5A, 5B. The holes 5A, 5B may be preformed in the nucleus 5, that is to say the two holes 5A, 5B may, for example, be made during the manufacturing of the nucleus 5, by cutting and removal of material. It is, however, feasible for the holes 5A, 5B to be directly made by the core 4 when the core 4 passes through the nucleus 5, the core 4 thus directly perforating the nucleus 5 to make the holes 5A, 5B.

Advantageously, in the course of the assembly step, the longitudinal branches 7A, 7B of the pin 7 are thus inserted in the holes 5A, 5B, respectively.

Hereinabove, we have described the implementation of a simple stirrup (formed by the pin 7) with only two longitudinal branches. It is, of course, feasible to implement the present disclosure with a double stirrup presenting four longitudinal branches in cooperation with a nucleus 5 which has four holes.

Hereinabove, we have also described an instrument 1 in which the one-piece parts forming the nucleus 5 and the means of application 6 are all identical. It is, of course, feasible to produce an instrument 1 with parts of different thicknesses, shapes, dimensions and consistencies (and, therefore, different nuclei and means of application), which are stacked by families or randomly, without departing from the scope of the present disclosure.

It is also feasible to insert free fibers between each nucleus 5 of the stack illustrated, for example, in FIG. 2, in such a way that the fibers pass through the interstitial space delimited by the two longitudinal branches 7A, 7B. Thus, during the twisting step, not only will the nuclei 5 be angularly offset, which will lead to the forming of helical layers of protuberances 6A, but the fibers will also expand under the effect of the twisting of the core 4 thus enabling a "mixed" application head comprising protuberances 6A and fibers.

It is also feasible, following the core 4 twisting step, for the general profile of the application head of the instrument 1 to be modified by machining, that is to say by removal of material in the helical layers formed by the protuberances 6A.

The invention claimed is:

1. An instrument for applying a product to epidermal derivatives, the instrument comprising:

a) an elongated core for providing a plastically deformed twisted portion; and b) a plurality of distinct nuclei stacked against each other, each nucleus supporting an applicator of the product, wherein the plurality of distinct nuclei are independent from each other and do not form a single piece, wherein the core passes through each nucleus, and wherein the core and the nucleus are connected to prevent the nucleus from pivoting freely on the core.

2. The instrument of claim 1, wherein the nuclei are basically identical to each other.

3. The instrument of claim 1, wherein the applicator comprises protuberances protruding from the nucleus.

4. The instrument of claim 1, wherein applicator is associated with the nucleus.

5. The instrument of claim 1, wherein the nucleus is a plate.

6. The instrument of claim 1, wherein the instrument is a mascara applicator for eyelashes.

7. The instrument of claim 1, wherein each nucleus comprises a central member having at least one aperture defined therein and further comprises a plurality of applicators extending outward from the central member.

8. The instrument of claim 7, wherein the nucleus is solid and generally disk shaped.

9. The instrument of claim 7, wherein the nucleus is solid and elongated, the at least one aperture extending axially through the nucleus.

10. An instrument for applying a product to epidermal derivatives, the instrument comprising:

a) an elongated core plastically deformed to form a twisted portion; and b) at least one nucleus supporting an applicator of the product, whereby the core passes through the nucleus, whereby the core and the nucleus are connected to prevent the nucleus from pivoting freely on the core, and whereby the twisted portion has a plurality of protuberances integral with and protruding helically from the nucleus, the plurality of protuberances protruding helically as a result of plastic deformation of the elongated core.

11. The instrument of claim 10, wherein the protuberances extend radially and in a spiral from the twisted portion.

12. The instrument of claim 10, wherein the protuberances are expanded as a result of plastic deformation of the twisted portion.

13. A method of manufacturing an instrument for applying a product to epidermal derivatives, the method comprising:

a) providing an elongated core;

b) providing at least one nucleus supporting an applicator of said product;

c) assembling said core and at least one nucleus such that the core passes through the nucleus; and d) plastically deforming the core by twisting, wherein the core and the nucleus are connected to prevent the nucleus from pivoting freely on the core, and wherein the core is twisted.

14. The method of claim 13, wherein a plurality of nuclei each supporting a corresponding means of application are manufactured during step b), and wherein said nuclei are stacked on each other during step c), each nucleus is passed through by the core.

15. The method of claim 13, wherein the instrument is a mascara applicator for eyelashes.

16. A method of manufacturing an instrument for applying a product to epidermal derivatives, the method comprising:

a) providing an elongated core;

b) providing at least one nucleus supporting an applicator of the product; and c) assembling said core and at least one nucleus such that the core passes through the nucleus, wherein the core and the nucleus are connected to prevent the nucleus from pivoting freely on the core, wherein the core is twisted, and wherein a one-piece part forming the nucleus and the means of application supported by the nucleus are cut in a plate during step b).

17. The method of claim 16, wherein the means of application supported by said nucleus are cut in the plate with a laser.

18. An instrument for applying a product to epidermal derivatives, the instrument comprising:

a) an elongated core having at least a portion of which is twisted, wherein the core comprises at least one U-shaped pin with two longitudinal branches connected by a transverse arm, the nucleus having two holes in which said longitudinal branches are inserted; and b) at least one nucleus supporting an applicator of said product, wherein said core passes through said nucleus, and wherein the core and the nucleus are connected to prevent the nucleus from pivoting freely on the core.

19. A method of manufacturing an instrument for applying a product to epidermal derivatives, the method comprising:

a) providing an elongated core;

b) providing at least one nucleus supporting an applicator of the product; and c) assembling said core and at least one nucleus such that the core passes through the nucleus wherein the core and the nucleus are connected to prevent the nucleus from pivoting freely on the core, and wherein the core is twisted, the twisting step being carried out after the assembly step.

20. A method of manufacturing an instrument for applying a product to epidermal derivatives, the method comprising:

a) providing an elongated core;

b) providing at least one nucleus supporting an applicator of the product; and c) assembling said core and at least one nucleus such that the core passes through the nucleus, wherein the core and the nucleus are connected to prevent the nucleus from pivoting freely on the core, wherein the core is twisted, wherein a U-shaped pin with two longitudinal branches connected by a transverse arm is manufactured or procured during step a), wherein at least one nucleus supporting the applicator is manufactured or procured during step b), the nucleus having two holes, and wherein the longitudinal branches are inserted in the two holes, respectively, during step c).

21. An instrument for applying a product to epidermal derivatives, the instrument comprising:

a) a plurality of nuclei, each nucleus supporting a corresponding applicator of the product, wherein the plurality of nuclei are independent from each other and do not form a single piece; and, b) an elongated twisted core, wherein the core passes through each nucleus, wherein the nuclei are stacked against each other, and wherein the core and the nucleus are connected to prevent the nucleus from pivoting freely on the core.

22. An instrument for applying a product to epidermal derivatives, the instrument comprising:

a) an elongated one-piece twisted core; and b) at least one nucleus supporting an applicator of the product and having a single non-circular shaped through-hole defined therein, wherein each nucleus has a single non-circular shaped through hole which is bounded by an edge with a rectilinear portion, and wherein each nucleus is adapted to support at least one protuberance which extends helically as a result of the plastic deformation of the elongated core wherein the core passes through the nucleus, wherein the core and the nucleus are connected to prevent the nucleus from pivoting freely on the core, the through-hole cooperating with the core, the cross-section of the core being of a shape matching that of the through-hole.

* * * * *